US006908290B2

(12) United States Patent
Pitla et al.

(10) Patent No.: US 6,908,290 B2
(45) Date of Patent: Jun. 21, 2005

(54) AIR CONDITIONING COMPRESSOR HAVING REDUCED SUCTION PULSATION

(75) Inventors: Srinivas S. Pitla, Canton, MI (US); Vipen Khetarpal, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 155 days.

(21) Appl. No.: 10/427,444

(22) Filed: May 1, 2003

(65) Prior Publication Data

US 2004/0219043 A1 Nov. 4, 2004

(51) Int. Cl.[7] ..... F04B 27/08

(52) U.S. Cl. ..... 417/269; 417/222.2; 417/450; 417/312; 417/540; 251/61.5; 251/129.02; 251/129.15; 251/125.18

(58) Field of Search ..... 417/222.2, 450, 417/312, 540, 269; 251/61.5, 129.18, 129.02, 129.15

(56) References Cited

U.S. PATENT DOCUMENTS

| | | | | |
|---|---|---|---|---|
| 4,392,788 A | | 7/1983 | Nakamura et al. | |
| 4,583,922 A | | 4/1986 | Iijima et al. | |
| 4,813,852 A | | 3/1989 | Ikeda et al. | |
| 4,930,995 A | | 6/1990 | Suzuki et al. | |
| 5,129,792 A | | 7/1992 | Abousabha | |
| 5,342,178 A | * | 8/1994 | Kimura et al. | 417/269 |
| 5,674,054 A | | 10/1997 | Ota et al. | |
| 5,702,236 A | | 12/1997 | Ikeda | |
| 5,733,107 A | | 3/1998 | Ikeda et al. | |
| 5,762,476 A | * | 6/1998 | Ota et al. | 417/222.2 |
| 6,012,905 A | * | 1/2000 | Takashima et al. | 417/222.1 |
| 6,012,908 A | * | 1/2000 | Tanaka et al. | 417/312 |
| 6,045,342 A | | 4/2000 | Kimura | |
| 6,146,106 A | * | 11/2000 | Suitou et al. | 417/222.2 |
| 6,176,687 B1 | | 1/2001 | Kim et al. | |
| 6,250,892 B1 | | 6/2001 | Kato et al. | |
| 6,318,972 B1 | | 11/2001 | Huang et al. | |
| 6,386,846 B1 | * | 5/2002 | Murase et al. | 417/540 |
| 6,705,843 B1 | * | 3/2004 | Kuo | 417/312 |

* cited by examiner

*Primary Examiner*—Cheryl Tyler
*Assistant Examiner*—Emmanuel Sayoc
(74) *Attorney, Agent, or Firm*—Brinks Hofer Gilson & Lione

(57) ABSTRACT

A compressor for an automotive air conditioning system includes a cylinder head that comprises a mixing chamber, suction chamber and discharge chamber. The cylinder head comprises a first annular wall defining a mixing chamber and a second annular wall disposed about the first annular wall and spaced apart therefrom to define the suction chamber that communicates with the suction ports to the cylinder chambers. The discharge chamber is disposed about the second annular wall and communicates with the discharge ports. Refrigerant flows through the mixing chamber in a swirling or other turbulent pattern and into suction chamber through circumferentially spaced openings. By providing the mixing chamber and isolating the mixing chamber from the suction chamber, pressure pulsation resulting from opening of the suction ports to admit refrigerant is reduced.

14 Claims, 2 Drawing Sheets

AIR CONDITIONING COMPRESSOR HAVING REDUCED SUCTION PULSATION

TECHNICAL FIELD OF THE INVENTION

This invention relates to a compressor for an automotive air conditioning system. More particularly, this invention relates to such compressor that includes a suction chamber that is configured to reduce pressure pulsations in refrigerant that is supplied to the compressor.

BACKGROUND OF THE INVENTION

An air conditioning system, such as for an automotive vehicle, comprises a compressor that delivers compressed refrigerant to a condenser, wherein heat is extracted from the refrigerant. The refrigerant flows from the condenser to an evaporator that expands the refrigerant to extract heat from the ambient. The spent refrigerant is recycled from the evaporator to the compressor. The compressor typically comprises pistons that reciprocate within cylinder chambers to draw in the spent refrigerant, compress the refrigerant, and discharge the compressed refrigerant to the condenser. Within the compressor, the refrigerant travels through a head that includes a suction chamber for supplying spent refrigerant to the cylinders and a discharge chamber that receives the compressed refrigerant. Suction ports with valves regulate refrigerant flow from the suction chamber to the cylinder chambers, whereas discharge ports with valves regulate refrigerant flow from the cylinder chambers to the discharge chamber.

The refrigerant within the suction chamber exhibits a relatively low pressure within the system. During the suction stroke, the piston is withdrawn to increase the volume within the cylinder chamber, and the valve opens to admit refrigerant through the suction port. Refrigerant flow into the cylinder chamber produces a temporary drop in the pressure of suction-side refrigerant. As each piston successively cycles through the suction stroke, the result is a regular fluctuation in suction-side pressure, referred to as pressure pulsation. This pressure pulsation is noticeable not only within the suction chamber, but also through the line to the evaporator, and results in vibration and increased noise within the system. Moreover, there is a desire to reduce the number of pistons within the compressor to thereby reduce cost and weight. However, pressure pulsation becomes more noticeable as the number of pistons is reduced, thereby increasing the associated flow-induced vibration and noise problems.

Therefore, a need exists for a compressor for an automotive air conditioning system having a suction chamber that confines pressure pulsation and thereby minimizes propagation of flow-induced vibration and noise through the suction-side components.

BRIEF SUMMARY OF THE INVENTION

This invention provides a compressor for an automotive air conditioning system that includes a cylinder block defining a plurality of cylinder chambers and pistons reciprocately received in the cylinder chambers. The compressor also includes a cylinder head that comprises a suction chamber and discharge chamber. Suction ports communicate between the cylinder chambers and the suction chamber for admitting refrigerant from the suction chamber into the cylinder chamber. Discharge ports communicate between the cylinder chambers and the discharge chamber for discharging refrigerant from the cylinder chambers to the discharge chamber. In accordance with this invention, the cylinder head comprises a first annular wall defining a mixing chamber and a second annular wall disposed about the first annular wall and spaced apart therefrom to define the suction chamber. The discharge chamber is disposed about the second annular wall. An inlet is provided for supplying refrigerant to the mixing chamber. Preferably, fluid flows through the mixing chamber in a swirling or other turbulent pattern to provide a more uniform pressure through the upstream components. The first annular wall that divides the mixing chamber from the suction chamber includes at least two openings in circumferentially spaced relationship for passing fluid from the mixing chamber to the suction chamber. By providing the mixing chamber and isolating the mixing chamber from the suction chamber by the first annular wall, pressure pulsation resulting from opening of the suction ports to admit refrigerant from the suction chamber to the cylinder chambers is confined to the suction chamber, and pulsation propagation through the mixing chamber to other suction-side components is reduced. This reduces flow-induced vibration and noise within the automotive air conditioning system.

BRIEF DESCRIPTION OF THE DRAWINGS

This invention will be further illustrated with reference to the accompanying drawings wherein.

DETAILED DESCRIPTION OF THE INVENTION

Figure 1:
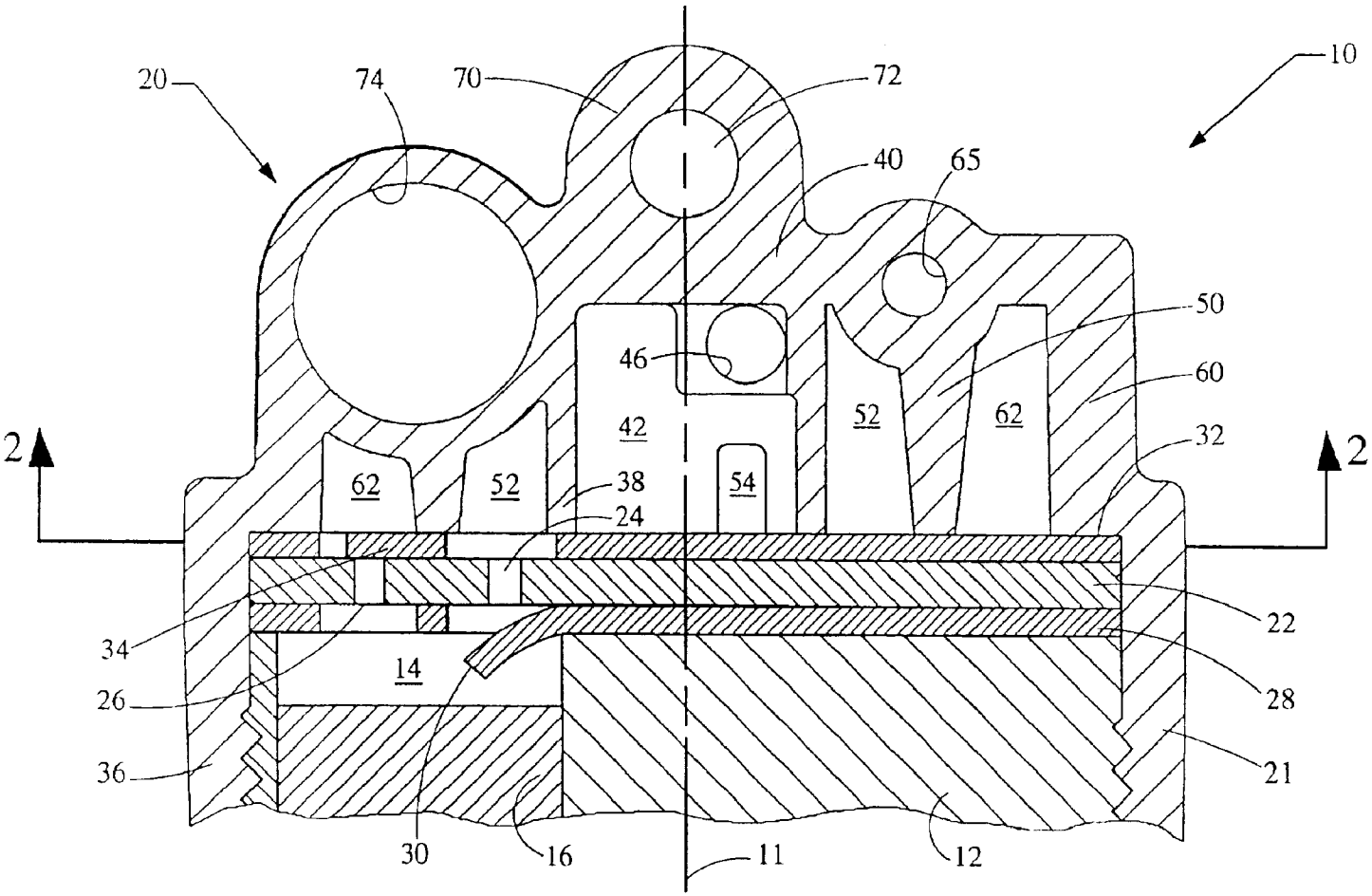
FIG. 1 is a cross-section of an air conditioning compressor in accordance with a preferred embodiment of this invention.
Figure 2:
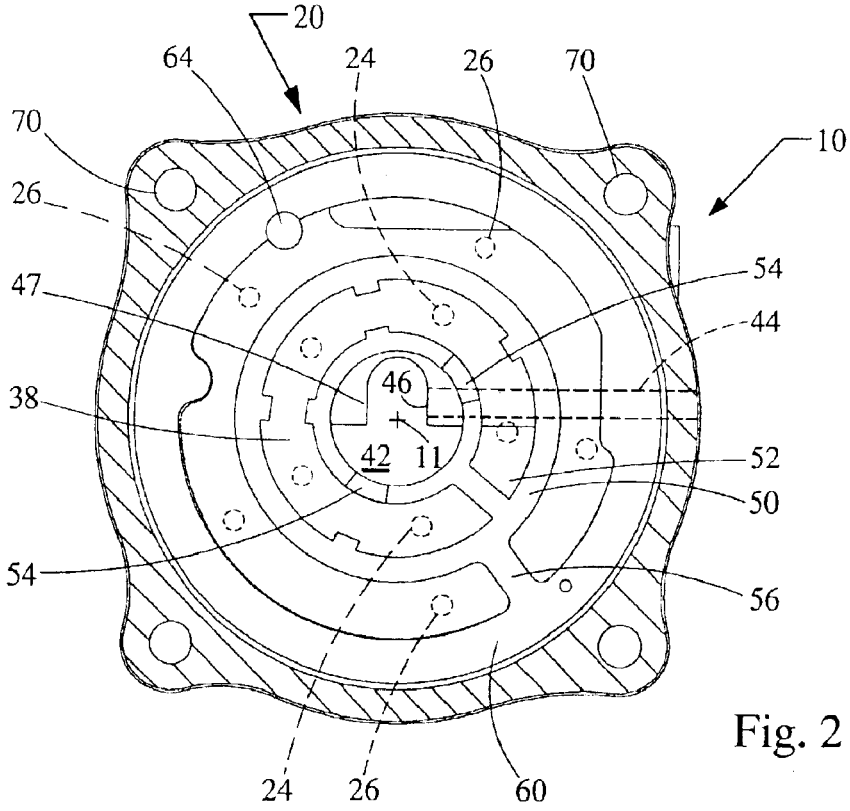
FIG. 2 is a cross-section of the air conditioning system in FIG. 1 taken along lines 2—2 in the direction of the arrows.

In accordance with a preferred embodiment of this invention, referring to FIGS. 1 and 2, there is depicted a rear portion of a compressor 10 adapted for an automotive air conditioning system to compress a refrigerant. Suitable refrigerants include organic compounds, such as refrigerant designated R134. Alternately, this invention may be used with carbon dioxide refrigerant, which require higher pressures that result increased vibration and noise due to suction-side pulsation. Compressor 10 has a central longitudinal axis 11 and comprises a cylinder head 12, which may be part of a rear housing section. Cylinder head 12 defines a plurality of cylinder chambers 14 coaxial to axis 11. In the described embodiment, cylinder block 12 includes five cylinder chambers equal angularly spaced about axis 11. However, this invention may be utilized with compressors that included 3, 4 or any suitable number of cylinders. Pistons 16 are slideably received in cylinder chambers 14 and are reciprocated by a swashplate mounted on a shaft, which is in turn driven by the automotive engine through a belt and pulley mechanism. A suitable swashplate mechanism is described in U.S. Pat. No. 6,318,972, incorporated herein by reference. During operation, each piston 16 reciprocates to retract the piston to draw relatively low pressure refrigerant into the cylinder chamber and to advance the piston to compress the refrigerant and discharge compressed refrigerant from the cylinder chamber. The motion of the multiple pistons is sequenced by the swashplate mechanism, so that some pistons are being withdrawn while others are being advanced, thereby providing an continuous flow of refrigerant through the air conditioning compressor. In FIG. 1, the piston is depicted in a stage of being withdrawn to suck refrigerant into the cylinder chamber.

Compressor 10 also comprises a rear head 20 for supplying refrigerant to the cylinder chambers and receiving compressed refrigerant therefrom. In the described embodiment, rear head 20 includes an internally threaded collar 21 for mounting onto cylinder head 12. A valve plate 22 is interposed between cylinder head 12 and the refrigerant chambers within rear head 20. Valve plate 22 defines suction ports 24 for admitting refrigerant to cylinder chambers 14 and discharge ports 26 for discharging compressed refrigerant therefrom. A flexible membrane 28 overlying valve plate 22 adjacent cylinder head 12 is cut to define reed valves 30 to regulate refrigerant flow through suction ports 24. Similarly, a flexible membrane 32 overlying valve plate 22 opposite cylinder head 12 defines reed valves 34 to regulate refrigerant flow through discharge ports 26.

In accordance with this invention, the rear head includes a pattern of walls that define chambers for conveying refrigerant. In particular, head 20 comprises a first annular wall 38 that cooperates with an end wall 40 to define a mixing chamber 42. Refrigerant is admitted to mixing chamber 42 through an inlet passage 44 that is externally connected to a tube leading from an evaporator. Refrigerant enters chamber 42 through an opening 46. In the preferred embodiment, opening 46 is offset from the center of the mixing chamber, which corresponds to axis 11, and directs flow toward a deflector 47. The offset arrangement of opening 46 and deflector 47 creates a swirling flow of refrigerant within mixing chamber 42 which facilitates the mixing of refrigerant, thereby providing a more uniform pressure and reducing pulsations within the suction-side fluid.

Rear head 20 also includes a second annular wall 50 generally cylindrical about axis 11 and spaced outboard from first annular wall 38 to define a suction chamber 52 therebetween. Ports 54 in first annular wall 38 provide refrigerant flow from mixing chamber 42 into suction chamber 52. It is a feature of this embodiment that ports 54 are axially displaced from opening 46 to enhance swirling flow of refrigerant through mixing chamber 42 and provide a more uniform mixture to suction chamber 52. Suction ports 24 to cylinder chamber 14 are located to communicate with suction chamber 52, as indicated by the dashed lines in FIG. 2. A wall 56 extends radially through suction chamber 52 to block circumferential propagation of pressure pulsations within suction chamber 52. During operation, pistons 16 draw refrigerant from suction passage 52 in a circumferential sequence, opening the inlet valves and creating a pressure pulse in the region adjacent the suction port. Wall 56 limits the pulses accumulating beyond a single revolution and thereby reduces the amplitude of the pressure pulsations and the associated flow-induced vibration and noise. In addition, wall 38 limits communication between mixing chamber 42 and suction chamber 52 and thus isolates pressure pulsations within suction chamber 52 from mixing chamber 42. This reduces propagation of pulsations through inlet passage 44 to other components of the air conditioning system.

Head 20 further includes an outer wall 60 spaced apart from wall 50 to define discharge chamber 62. Discharge ports 26 from cylinder chambers 14 are located to communicate with discharge chamber 62, as indicated by the dashed lines in FIG. 2. From discharge chamber 62, refrigerant flows through a discharge port 64 to an outlet passage 65. Passage 65 includes an oil separator (not shown) to recapture excess lubricant from the discharged refrigerant. The oil separator also serves as a muffler to restrict propagation of discharge-side pressure pulsations out of head 64 to other components. Discharge passage 64 is coupled to a tube that leads to the condenser of the air conditioning system.

Head 20 includes bores 70 for bolting the rear head to the other housing sections, and bore 72 for receiving a bolt to mount compressor 10 to the vehicle. Also, a chamber 74 is provided for enclosing a control valve assembly (not shown).

During operation, spent refrigerant from the evaporator is conveyed through a tube to inlet passage 44 and admitted through opening 46 into mixing chamber 42. The offset arrangement of opening 46 and deflector creates a swirling flow of refrigerant through the mixing chamber to minimize pressure variations therein. Refrigerant flows radially through ports 54 into suction chamber 52. As piston 16 is withdrawn from valve plate 22 to expand the volume within cylinder chamber 14, refrigerant flows from suction chamber 52 through suction port 24 into the cylinder chamber, with valve 30 opening to admit the fluid. Thereafter, as piston 16 travels toward valve plate 22 to compress the refrigerant, valve 30 closes, and valve 36 opens to expel the compressed fluid into discharge chamber 62. Refrigerant flows from discharge chamber 62 through discharge port 64 and passage 65, and is output from the compressor to a tube en route to the condenser.

Thus, this invention provides an arrangement of refrigerant chambers wherein the refrigerant is input to a mixing chamber and radially distributed to a suction chamber that is separated by a wall. Pressure pulsation caused by withdrawal of fluid by the cylinder chambers occur within the suction chamber and are restricted from propagation to the mixing chamber. Thus, the mixing chamber provides a barrier to pulsation propagation to external components. By locating the suction chamber inward from the discharge chamber, suction pulsation is further confined within the rear head, thereby further reducing associated vibration and noise. Thus, this invention provides a compressor wherein flow-induced noise and vibration attributed to suction-side pulsation is reduced. Moreover, the preferred embodiment includes a radial wall to block circumferential travel of pulsation through the suction chamber and thereby reduce the amplitude of the pulsation within the suction chamber.

Figure 3:
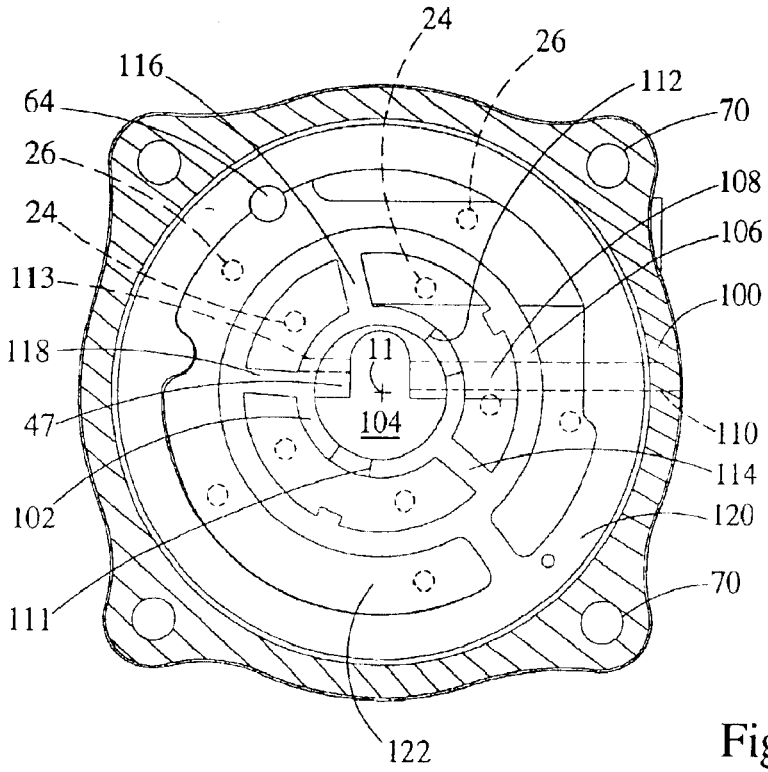
FIG. 3 is a view showing a head in accordance with an alternate embodiment of this invention.

In the embodiments depicted in FIGS. 1 and 2, a single radial wall is provided to block circumferential propagation of pulsations. Nevertheless, the amplitude of pulsations is permitted to build up through the suction chamber prior to the wall. Referring now to FIG. 3, there is depicted an alternate embodiment of this invention that includes multiple radial walls within the suction chamber to further confine pulsations to limited regions. In FIG. 3, like numerals are employed to represent elements common to the embodiment in FIGS. 1 and 2. A rear head 100 comprises a first annular wall 102 that defines a central mixing chamber 104, and a second annular wall 106 that encircles first annular wall 102 and spaced apart therefrom to define a suction chamber 108. Refrigerant is delivered to mixing chamber 104 through inlet passage 110, which is offset relative to axis 11 to create a swirling flow pattern. Refrigerant is distributed from mixing chamber 104 to suction chamber 108 through openings 111 and 112 and passage 113. Multiple walls 114, 116 and 118 extend generally radially to divide suction chamber 108 into sub-chambers. In this example, wherein the compressor comprises five cylinder chambers, suction chamber 108 communicates with suction ports to two pistons through opening 111, with the suction ports to two other cylinder chambers through opening 112, and with the remaining one cylinder chamber through passage 113. Thus, pressure pulsation created by the two cylinder chambers is isolated to regions of the suction chamber that communicate with no more than two cylinder chambers. Head 100 further comprises an outer wall 120 that is disposed about the second annular wall 106 and spaced apart therefrom to define a discharge chamber 122, in a manner similar to the embodiments in FIGS. 1 and 2. In this manner, discharge chamber 122 isolates suction chamber 108 from the outer wall 120 to confine suction-side pulsation within the center of the head. As in the first described embodiment, head 100 provides a mixing chamber with a swirling flow pattern to provide a more uniform pressure within the fluid within the head and thereby alternate pressure pulsation.

In the embodiment in FIG. 3, radial walls were arranged to divide the suction chamber into subchambers such that each subchamber communicates with no more than 2 cylinder chambers. Alternately, walls may be arranged to form subchambers that communicate with single cylinder chambers, or with 2 and 3 cylinder chambers.

While this invention has been described in terms of certain embodiments thereof, it is not intended to be so limited, but rather only to the extent set forth in the claims that follow.

What is claimed is:

1. A compressor for an automotive air conditioning system comprising:

a cylinder block defining a plurality of cylinders;

pistons reciprocally received in said cylinder;

a cylinder head comprising a first annular wall defining a mixing chamber, a second annular wall disposed about the first annular wall and spaced apart therefrom to define a suction chamber; and a discharge chamber disposed about said second annular wall, said cylinder head comprising an inlet communicating with said mixing chamber for admitting fluid thereto, said first annular wall comprising at least two openings in circumferentially spaced relationship for admitting fluid from said mixing chamber to said suction chamber;

suction ports communicating between said cylinders and said suction chamber for admitting fluid from said suction chamber into said cylinders; and discharge ports communicating between said cylinders and said discharge chamber for discharging fluid from said cylinders to said discharge chamber;

wherein said cylinder head includes at least one wall between said first annular wall and said second annular wall effective to block circumferential propagation of pressure pulsations through said suction chamber.

2. A compressor for an automotive air conditioning system according to claim 1 wherein said compressor comprises a central axis, said pistons reciprocate parallel to said central axis, and said first annular wall is generally symmetrical about the central axis.

3. A compressor for an automotive air conditioning system according to claim 2 wherein said inlet directs refrigerant tangentally relative to said axis to create a swirling flow within the mixing chamber.

4. A compressor for an automotive air conditioning system according to claim 2 wherein said inlet is axially space from said openings.

5. A compressor for an automotive air conditioning system according to claim 2 wherein refrigerant flows radially through said openings from said mixing chamber to said suction chamber.

6. A compressor for an automotive air conditioning system according to claim 1 further comprising a valve plate interposed between said cylinder block and said cylinder head and comprises said suction ports.

7. A compressor for an automotive air conditioning system according to claim 1 wherein said cylinder head comprises at least two radial walls dividing said suction chamber into subchambers, and wherein at least one subchamber communicates with at least two suction ports.

8. A compressor for an automotive air conditioning system comprising:

a cylinder block defining a plurality of cylinders;

pistons reciprocally received in said cylinder;

a cylinder head comprising a first annular wall defining a mixing chamber, a second annular wall disposed about the first annular wall and spaced apart therefrom to define a suction chamber, and a discharge chamber disposed about said second annular wall, said cylinder head comprising an inlet communicating with said mixing chamber for admitting fluid thereto, said first annular wall comprising at least two openings in circumferentially spaced relationship for admitting fluid from said mixing chamber to said auction chamber;

suction ports communicating between said cylinders and said suction chamber for admitting fluid from said suction chamber into said cylinders; and discharge ports communicating between said cylinders and said discharge chamber for discharging fluid from said cylinders to said discharge chamber;

wherein said cylinder head comprises at least two radial walls dividing said suction chamber into subchambers, and wherein at least one subchamber communicates with at least two suction ports.

9. A compressor for an automotive air conditioning system according to claim 8 wherein said cylinder head includes at least one wall between said first annular wall and said second annular wall effective to block circumferential propagation of pressure pulsations through said suction chamber.

10. A compressor for an automotive air conditioning system according to claim 8 wherein said compressor comprises a central axis, said pistons reciprocate parallel to said central axis, and said first annular wall is generally symmetrical about the central axis.

11. A compressor for an automotive air conditioning system according to claim 10 wherein said inlet directs refrigerant tangentally relative to said axis to create a swirling flow within the mixing chamber.

12. A compressor for an automotive air conditioning system according to claim 10 wherein said inlet is axially space from said openings.

13. A compressor for an automotive sir conditioning system according to claim 10 wherein refrigerant flows radially through said openings from said mixing chamber to said suction chamber.

14. A compressor for an automotive air conditioning system according to claim 8 further comprising a valve plate interposed between said cylinder block and said cylinder head and comprises said suction ports.

* * * * *